US011776797B2

(12) United States Patent
Hughes

(10) Patent No.: US 11,776,797 B2
(45) Date of Patent: Oct. 3, 2023

(54) VACUUM CELL CONFIGURED FOR REDUCED INNER CHAMBER HELIUM PERMEATION

(71) Applicant: ColdQuanta, Inc., Boulder, CO (US)

(72) Inventor: Steven Michael Hughes, Louisville, CO (US)

(73) Assignee: ColdQuanta, Inc., Boulder, CO (US)

( * ) Notice: Subject to any disclaimer, the term of this patent is extended or adjusted under 35 U.S.C. 154(b) by 0 days.

(21) Appl. No.: 17/667,433

(22) Filed: Feb. 8, 2022

(65) Prior Publication Data

US 2022/0262609 A1 Aug. 18, 2022

Related U.S. Application Data

(60) Provisional application No. 63/149,249, filed on Feb. 13, 2021.

(51) Int. Cl.

| | |
|---|---|
| ***H01J 41/12*** | (2006.01) |
| *F04B 37/04* | (2006.01) |
| *F04B 37/14* | (2006.01) |
| *F04B 15/08* | (2006.01) |

(52) U.S. Cl.

CPC ..... *H01J 41/12* (2013.01); *F04B 37/04* (2013.01); *F04B 37/14* (2013.01); *F04B 2015/082* (2013.01)

(58) Field of Classification Search

CPC ..... H01J 41/12; F04B 37/04; F04B 2015/082; F04B 37/14

See application file for complete search history.

(56) References Cited

U.S. PATENT DOCUMENTS

| | | | | |
|---|---|---|---|---|
| 8,546,748 | B2 * | 10/2013 | Hughes | C03C 23/0075 250/251 |
| 2003/0201606 | A1 * | 10/2003 | Shinozaki | F16J 15/406 277/411 |
| 2006/0267023 | A1 | 11/2006 | McBride | |
| 2009/0212204 | A1 | 8/2009 | McBride | |
| 2010/0034668 | A1 | 2/2010 | Cappuzzo | |
| 2015/0200029 | A1 | 7/2015 | Hughes | |
| 2018/0233337 | A1 | 8/2018 | Hughes | |
| 2018/0233338 | A1 | 8/2018 | Hughes | |
| 2020/0103032 | A1 * | 4/2020 | Hughes | F16J 15/064 |

OTHER PUBLICATIONS

Boudot et al., Enhanced Observation Time of Magneto-Optical Traps using Micro-Machined Non-Evaporable Getter Pumps, Aug. 3, 2020, pp. 1-9.

Rushton et al., The Feasibility of a Fully Miniaturized Magneto-Optical Trap for Portable Ultracold Quantum Technology, May 13, 2014, pp. 1-23.

* cited by examiner

*Primary Examiner* — Thomas Fink

(74) *Attorney, Agent, or Firm* — Van Pelt, Yi & James LLP

(57) ABSTRACT

A vacuum cell is described. The vacuum cell includes an inner chamber, a buffer channel, and a buffer ion pump. The buffer channel is fluidically isolated from the inner chamber and fluidically isolated from an ambient external to the vacuum cell. The buffer ion pump is fluidically coupled to the buffer channel and fluidically isolated from the ambient and the inner chamber.

19 Claims, 7 Drawing Sheets

VACUUM CELL CONFIGURED FOR REDUCED INNER CHAMBER HELIUM PERMEATION

CROSS REFERENCE TO OTHER APPLICATIONS

This application claims priority to U.S. Provisional Patent Application No. 63/149,249 entitled VACUUM CELL WITH BUFFER ION PUMP filed Feb. 13, 2021 which is incorporated herein by reference for all purposes.

BACKGROUND OF THE INVENTION

Vacuum cells capable of achieving a high vacuum or an ultra-high vacuum (UHV), e.g. pressures of $10^{-9}$ Torr or less, in inner chambers may be utilized in a number of applications. For example, such vacuum cells may be used in cold atom technologies, in which atoms in the inner chamber reach and are maintained at temperatures well under 1 K. Cold atoms in such vacuum cells may be used in quantum computing, basic research, sensors, as well as other technologies.

In some cases, such vacuum cells may have their inner chambers evacuated and hermetically sealed. Hermetic sealing generally prevents the movement of atoms from the ambient (i.e. outside of the vacuum cell) to the inner chamber in which the UHV is achieved. However, gases such as He may be capable of permeating the seal or bulk and reaching the inner chamber. Eventually, the helium gas can raise the pressure in the inner cell above a desired vacuum range, rendering the inner chamber unusable for its intended purpose. For example, some vacuum cells include transparent ports or covers sealed to the rest of the vacuum chamber through which optical access is maintained. Glasses such as borosilicate, fused silica, or others may be used for such applications. Other portions of the vacuum cell may be formed of silicon, another material, or even the same glass. During assembly of the vacuum cell, the glass is hermetically sealed to the silicon portion(s) of the vacuum cell. Although silicon and, to a lesser extent, borosilicate glass have low helium permeabilities, the hermetic seal may be made via an anodic bond or other bond which may result in some form of transition material. An anodic bond is sufficiently strong to maintain the seal between the glass cover and the body during use of the vacuum cell. Anodic bonds typically form a depletion region. The depletion region has a higher fraction of silicon dioxide ($SiO_2$) than the glass. $SiO_2$ has a significantly higher permeability to helium than silicon or the glass. Although the thickness of the depletion region may be on the order of a few microns or less, the depletion region may still be a significant source of helium permeation. Thus, helium may more rapidly permeate to the inner chamber through the depletion or transition region and render the vacuum cell unusable for UHV applications.

Although techniques for mitigating helium permeation are available, there are drawbacks. For example, a moat that surrounds the inner chamber can be formed and evacuated in order to mitigate helium permeation. In addition, materials having a lower permeability to helium, such as aluminosilicates or barrier coated materials, may be selected for use in the vacuum cell. However, because helium still permeates the materials, and because the seam resulting from anodic bonding may still be nearly pure $SiO_2$, the bulk permeation may have been decreased the perimeter depletion layer may still be the same. Thus the moat still continues to fill with helium. Eventually a sufficient amount of helium diffuses into the inner chamber to spoil the vacuum. Consequently, such techniques only prolong effective device lifetime. Accordingly, what is desired is a mechanism for mitigating the permeation of gases, such as helium, into UHV inner chambers of vacuum cells through not only the bulk material but also, through the depletion, seam, or transition material.

BRIEF DESCRIPTION OF THE DRAWINGS

Various embodiments of the invention are disclosed in the following detailed description and the accompanying drawings.

DETAILED DESCRIPTION

Figure 1A:
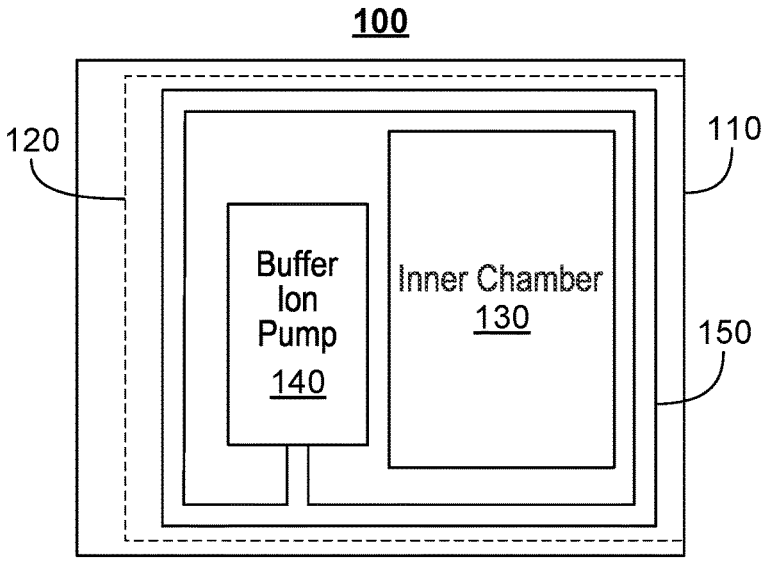
FIGS. 1A-1B are diagrams of an embodiment of a vacuum cell having reduced inner chamber permeability.

The invention can be implemented in numerous ways, including as a process; an apparatus; a system; and/or a composition of matter. In this specification, these implementations, or any other form that the invention may take, may be referred to as techniques. In general, the order of the steps of disclosed processes may be altered within the scope of the invention. Unless stated otherwise, a component described as being configured to perform a task may be implemented as a general component that is temporarily configured to perform the task at a given time or a specific component that is manufactured to perform the task.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

Vacuum cells utilize glassy materials (e.g. borosilicate glasses) to provide optical access to the inner, ultra-high vacuum (UHV) chamber of the vacuum cell. For example, a vacuum cell may include a silicon body and a glass cover. The silicon body includes the inner chamber UHV chamber. The glass cover is sealed to the silicon body and permits optical access to the inner chamber. However, helium leaks through most transparent glassy materials, as well as some crystalline materials, at a rate that shortens the usable life of inner chambers without active pumping. Active pumping may be undesirable for a variety of reasons. Further, when anodic bonding a glass to silicon to form a hermetic seal, a depletion layer is typically formed. The depletion layer is very rich in $SiO_2$ (e.g. may be nearly pure $SiO_2$). $SiO_2$ has a permeation rate significantly higher than the glass or silicon. Thus, helium permeation remains an issue.

Various techniques exist for mitigating helium permeation. For example, a moat that encloses the inner chamber and that is under vacuum may be created to address helium permeation. The buffer vacuum in the moat helps to reduce the ratio of helium on the moat walls, as compared to atmospheric helium, decreasing the total effective helium permeation rate. This extends the useful life of the inner chamber. However, such moats eventually fill with helium at rates depending on the surface to volume ratio of the moat coupled with permeation rates of the bulk materials and interface seals, and reach an equilibrium. Helium may then permeate the inner chamber and raise the pressure above the desired UHV ranges. Larger moats can extend the usable life of the inner chamber. However, the extension in the lifetime of the inner chamber scales linearly while the size of the moat scales at a higher rate. Further, the structure becomes more fragile and prone to failure as the moat gets deeper or wider and device volumetric scaling becomes impractical. Even with such measures, vacuum cell longevity is limited.

Although UHV ion pumps and other mechanical pumps may be used for the inner chamber to mitigate helium permeation induced pressure increases, such ion pumps have drawbacks. An ion pump within the inner chamber may have issues with stability at UHV pressures, may be relatively large, and may require increases in the magnetic field and operating voltage to maintain stable pumping for UHV pressure ranges at ever decreasing efficiencies. Further, helium is one of the most inefficiently pumped species. Techniques used to improve performance of the UHV ion pump do not scale well for size, weight, and power. Therefore, additional mitigation strategies are desirable to either prolong or indefinitely regenerate vacuum for the inner chamber of a vacuum cell.

A vacuum cell is described. The vacuum cell includes an inner chamber, a buffer channel, and a buffer ion pump. The buffer channel is fluidically isolated from the inner chamber and fluidically isolated from an ambient external to the vacuum cell. The buffer ion pump is fluidically coupled to the buffer channel and fluidically isolated from the ambient and the inner chamber.

In some embodiments, the vacuum cell includes a body and a cover hermetically sealed to the body by a bond. The inner chamber and the buffer channel are between an inner surface of the body and the cover. Further, the buffer channel is between the bond and the inner chamber. In some embodiments, the body and/or the cover has a depletion region proximate to the bond. The depletion region has a first thickness proximate to the ambient and a second thickness proximate to the buffer channel. The first thickness is greater than the second thickness. In some embodiments, the vacuum cell includes a bond sealant in the buffer channel. The bond sealant adjoins at least a portion of the bond. The bond seal may be a flowed sealant or a diffused sealant. The vacuum cell may also include a bond sealant reservoir that may retain the bond sealant during fabrication. In some embodiments, the cover includes a beveled, stepped, or tapered edge.

The vacuum cell may include a buffer ion pump chamber fluidically coupled with the buffer channel and a high vacuum chamber fluidically coupled with the inner chamber. The buffer ion pump is in the buffer ion pump chamber. The vacuum cell further includes an ultra-high vacuum pump in the high vacuum pump chamber. The ultra-high vacuum pump is an ultra-high vacuum ion pump in some embodiments. In some such embodiments, the buffer channel includes a high vacuum pump chamber portion that surrounds a portion the high vacuum pump chamber.

A vacuum cell including a body, a cover, a buffer ion pump, and an ultra-high vacuum pump is described. The cover is hermetically sealed to the body by a bond. The buffer channel is fluidically isolated from the inner chamber and from an ambient external to the vacuum cell. The buffer channel is between the bond and the inner chamber. The buffer ion pump is fluidically coupled to the buffer channel and fluidically isolated from the ambient and the inner chamber. The high vacuum pump is fluidically coupled with the inner chamber and fluidically isolated from buffer channel.

A method for providing a vacuum cell is described. The method includes providing a body having an inner chamber and a buffer chamber. A buffer ion pump is also provided in the buffer chamber. The method further includes hermetically sealing a cover to the body by a bond. A buffer channel is formed by the buffer chamber, between an inner surface of the body and the cover. The buffer channel is fluidically coupled to the buffer ion pump and fluidically isolated from an ambient and the inner chamber. An ultra-high vacuum pump fluidically coupled with the inner chamber and fluidically isolated from buffer channel may also be provided. In some embodiments, the ultra-high vacuum pump is an ultra-high vacuum ion pump. In some embodiments, the buffer channel includes a high vacuum pump chamber portion surrounding a portion of the ultra-high vacuum pump.

In such embodiments, hermetically sealing the cover to the body includes forming an anodic bond between the body and the cover. Thus, the bond is an anodic bond. The body and/or the cover has a depletion region proximate to the anodic bond. The anodic bond may be formed such that the depletion region has a first thickness proximate to the ambient and a second thickness proximate to the buffer channel, the first thickness being greater than the second thickness. A bond sealant may be provided in the buffer channel. The bond sealant adjoins at least a portion of the bond. In some embodiments, the bond sealant adjoins, and thus seals, the entire bond region. The bond sealant may be a flowed sealant (e.g. a sealant that flows when heated and solidifies during use) and/or a diffused sealant (e.g. a gaseous sealant that may diffuse into the depletion region. In some embodiments, the anodic bond may be annealed.

Figure 1B:
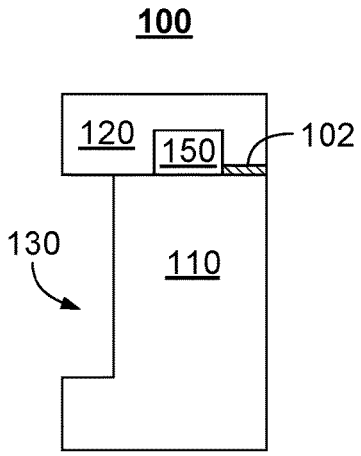

FIGS. 1A-1B are diagrams of an embodiment of vacuum cell 100 having reduced inner chamber permeability to, e.g., helium. FIG. 1A is a block diagram of vacuum cell 100, while FIG. 1B is a cross-sectional view of a portion of vacuum cell 100. For clarity, FIGS. 1A-1B are not to scale and only a portion of vacuum cell 100 is depicted. For example, atom sources and/or other components within inner chamber 130 are not shown. Further, although one inner chamber 130 is shown, multiple inner chambers may be present.

Vacuum cell 100 includes a vacuum cell structure that is formed by body 110 and cover 120 (denoted by dashed lines in FIG. 1A). Thus, the vacuum cell structure is referred to as vacuum cell structure 110/120. To form vacuum cell structure 110/120, body 110 is hermetically sealed with cover 120 via a bond. For example, cover 120 may be anodically bonded to body 110. Depletion region 102 depicted in FIG. 1B may be formed during the anodic bonding process. In some embodiments, another bonding process may be used to seal cover 120 to body 110.

Vacuum cell 100 includes inner chamber 130 and buffer channel 150 therein. In some embodiments, buffer channel 150 and inner chamber 130 are formed by cavities or apertures in body 110. In some embodiments, buffer channel 150 and/or a portion of inner chamber 130 are formed by cavities in cover 120. Thus, inner chamber 110 and buffer channel 150 may be considered to be defined by the inner surfaces of body 110 and cover 120. Inner chamber 130 and buffer channel 150 are fluidically isolated from the ambient (e.g. room temperature and pressure) external to vacuum cell 100. Inner chamber 130 is also fluidically isolated from buffer channel 150.

Inner chamber 130 is desired to be maintained at close to or UHV (e.g. $10^{-8}$ Torr or less, $10^{-9}$ Torr or less) or extreme high vacuum (XHV) (e.g. as low as $10^{-13}$ Torr or less). Inner chamber 130 is a locus of interaction between electromagnetic radiation (e.g., light, microwaves) and particles, e.g., neutral and/or charged atoms and/or polyatomic molecules. A UHV or XHV in inner chamber 130 facilitates such uses. Buffer channel 150 is evacuated, but may be at a higher pressure than inner chamber 130. Buffer channel 150 is depicted as encircling inner chamber 130 and buffer ion pump 140. In some embodiments, buffer channel 150 may only be around the perimeter of ion chamber 130. Although shown only near the perimeter of body 110, in some embodiments, buffer channel 150 may be in proximity to any anodic bond (or other bond) formed between cover 120 and body 110. Buffer channel 150 is between ion chamber 130 and the bond formed between cover 120 and body 110. Thus, buffer channel 150 is between ion chamber 130 and outer depletion region 102. In some embodiments, buffer channel 150 may be formed between other components of vacuum cell 100 and/or additional buffer channels may be present. In some embodiments, such a buffer channel may have a different geometry than that is shown for buffer channel 150. For example, a buffer channel may be a layer between two covers (i.e. a gap between the covers). Such a buffer channel may be fluidically connected to other buffer channel(s) or fluidically isolated from other buffer channels. Some buffer channels may be desired to be fluidically isolated if different permeation mitigation strategies are used for different chambers and/or if some permeation mitigation strategies are incompatible with some but not all buffer channels. For example, a flowable barrier or diffusion strategy for mitigating permeation (e.g. as described herein) may be used in some buffer channels (e.g. buffer channel 150) that mitigate bond seal permeation. Such flowable barrier and/or diffusion strategies may be desired to be isolated from buffer channels defined between two parallel offset optical windows/glass covers through which optical access is desired and where liquid flow and/or gas diffusion may obscure optical paths or change optical properties of the optically transparent materials. In such cases, bond seams may not intersect the buffer channel. The buffer channel may also be less prone to permeation through barrier coated or lower bulk permeation glass materials. Some embodiments may have buffer channels initially connected but then closed off during or prior to sealant flow/diffusion step.

In some embodiments, body 110 is formed from a low helium permeability material, such as silicon. However, other materials including transparent materials may be used for some or all of body 110. Further, although indicated as monolithic, body 110 may include multiple separate pieces that are assembled. Although indicated as extending over a particular portion of body 110, cover 120 may have a different configuration in some embodiments. Cover 120 provides optical access to inner chamber 130. Cover 120 is also desired to have a coefficient of thermal expansion (CTE) that matches the CTE of body 110 over the relevant temperature range (e.g. room temperature, operating temperature ranges and/or other temperatures used for fabrication). Thus, cover 120 may be a glassy material such as a borosilicate glass (e.g. BOROFLOAT® 33) and/or alternative glasses such as aluminosilicates (e.g. Hoya SD-2, Avanstrate Na32sg, CORNING® EAGLE XG® glass, and/or CORNING® GORILLA® glass) for a silicon body 110. In some embodiments, other material(s) may be used for cover 120.

Vacuum cell 100 may also include buffer ion pump 140, which may be in a chamber (not separately labeled in FIG. 1A) within vacuum cell structure 110/120. Buffer ion pump 140 is fluidically coupled to the buffer channel and fluidically isolated from the ambient. Buffer ion pump 140 is also fluidically isolated from inner chamber 130. Buffer ion pump 140 is used to provide a vacuum ("buffer vacuum") in buffer channel 150. For example, buffer ion pump 140 may be a high vacuum (HV) ion pump. Thus, a HV (e.g. pressures in the range of $10^{-3}$ Torr or $10^{-4}$ Torr through $10^{-9}$ Torr) may be maintained in buffer channel 150. In alternate embodiments, buffer ion pump 140 may be a UHV pump, which allows for the buffer vacuum in buffer channel 150 to be a UHV. However, in general, a HV buffer vacuum may be sufficient to significantly mitigate or eliminate issues due to gases (e.g. helium) permeating vacuum cell 100. Because buffer channel 150 is fluidically isolated from inner chamber 130 and the ambient, buffer ion pump 140 is primarily used to remove helium gas that has permeated into buffer channel 150 from the ambient through depletion region 102.

Buffer channel 150 in combination with buffer ion pump 140 may significantly extend the usable life of inner chamber 130 and, therefore, vacuum cell 100. The presence of buffer channel 150 under a buffer vacuum (e.g. HV) allows for helium that permeates through depletion region 102 (or through another portion of the bond/seam between body 110 and cover 120) to be captured before reaching inner chamber 110. More specifically, helium gas from the ambient permeates into buffer channel 150 through depletion region 102. Thus, the pressure within buffer channel 150 may increase. Buffer ion pump 140 is activated to remove helium (and/or other gases) that have permeated into buffer channel 150. In some embodiments, buffer ion pump 140 is activated only periodically (e.g. during a maintenance cycle) to remove the helium and need not be activated during use of inner chamber 130. For example, in some embodiments, buffer ion pump 140 may be activated for minutes per week, per month, or per year. In some embodiments, for example when used in conjunction with flowable barrier sealing or diffusion permeation mitigation strategies in buffer channel 150, buffer ion pump 140 may never need to be operated after the initial firing during or following initial vacuum processing of the UHV chamber. In some embodiments, buffer ion pump 140 may be activated during use of inner chamber 130. Use of buffer ion pump 140 thus maintains a very low helium partial pressure in buffer channel 150. Thus, helium (and/or other gas) permeation into inner chamber 130 may be reduced or prevented. Thus, the UHV of inner chamber 130 may be maintained for significantly longer periods. In some embodiments, the UHV of inner chamber 130 may be maintained substantially indefinitely (e.g. for months or years).

The pressure of helium in buffer channel 150 that is sufficiently small to reduce or prevent helium permeation from buffer channel 150 to inner chamber 130 may be greater than the UHV maintained in inner chamber 130. Since helium is the primary species capable of diffusing through glasses and other materials, while most other getterable species have a much more difficult or are practically unable to permeate, any pressure buildup in the buffer region by species other than helium does not threaten UHV inner chamber 130. As a result, such getterable species may be left in buffer channel 150 to allow for buffer ion pump 140 to maintain a higher pumping rate for helium that leaks into buffer channel 150. Because pressures are higher, buffer ion pump 140 may be smaller or employ weaker magnetic and electric fields for stable operation. For example, in some embodiments, buffer ion pump 140 may have a volume of not more than one or two cubic centimeters while maintaining operation. Stated differently, because a HV (rather than a UHV or XHV) is maintained in buffer channel 150 to prevent helium permeation, buffer ion pump 140 may be smaller than a UHV ion pump (not shown) that would be used within inner chamber 150 to remove helium therein at the same pumping speed. HV buffer ion pump 140 may not suffer from other issues related to a UHV ion pump (e.g. stability). Thus, the ability to reliably continue mitigating the permeation of helium into inner chamber 130 in a compact form factor is improved especially by potentially obviating the need for UHV ion pump leaving the UHV chamber to be pumped entirely by passive and evaporable getters.

Because helium is the main concern for permeation, buffer channel 150 may also be at higher pressures. Buffer channel 150 may be left "dirtier" or be able to be "made dirtier" by having a non-helium injectable gas. For example, the production/decomposition/reversible gettering of a solid compound via heat, radiation, or other evolutionary impetus/energy may provide a getterable gas. The injected getterable gas or electrons (which may be injected via, e.g., hot cathode emitters, electron guns, focused field or Spindt emitters, radiation induced ionization, and/or other means) are not a significant risk of permeation to inner chamber 130, but can help to maintain operation of buffer ion pump 140 at significantly higher speeds. Thus, buffer ion pump 140 may more readily remove helium from buffer channel 150. Consequently, longevity and usability of vacuum cell 100 (i.e. inner chamber 130) for UHV and/or XHV applications may be improved. Further, although a single buffer channel 150 is shown, buffer channel(s) may be provided between any region(s) in which a UHV is desired to be maintained (e.g. inner chamber 130) and a bond that seals vacuum cell 100 from the ambient. Stated differently, any seam that seals glass (and/or an analogous material) to silicon (and/or another analogous material) may have a corresponding buffer channel connected to buffer ion pump 140 or an analogous pump. Thus, one or more buffer channels and buffer ion pump(s) may be used to extend the usable lifetime of vacuum cells.

Figure 2A:
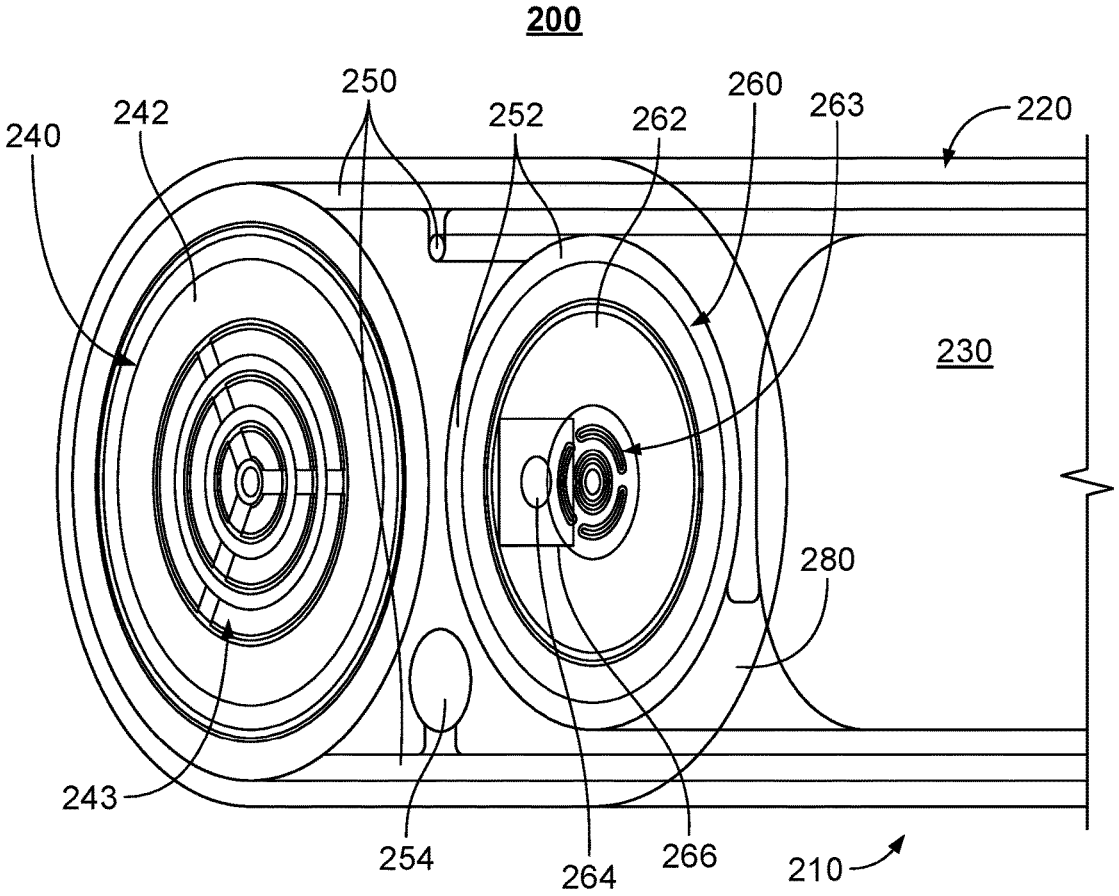
FIG. 2A-2D are diagrams depicting a portion of embodiments of a vacuum cell having reduced inner chamber permeability.
Figure 2B:
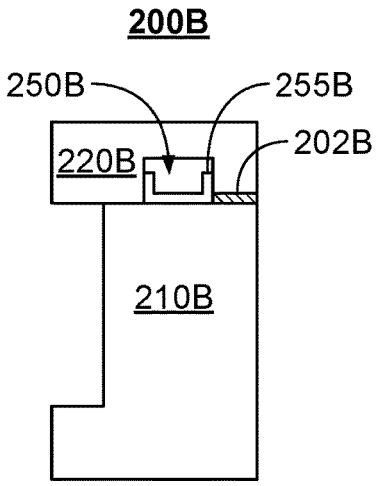
Figure 2C:
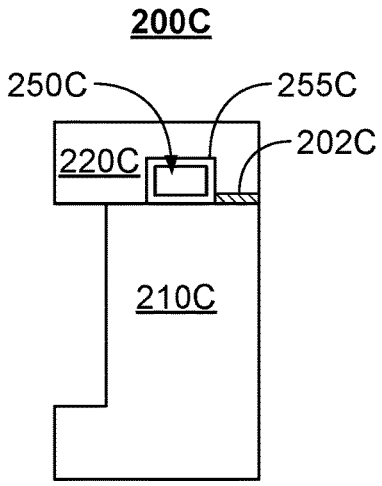
Figure 2D:
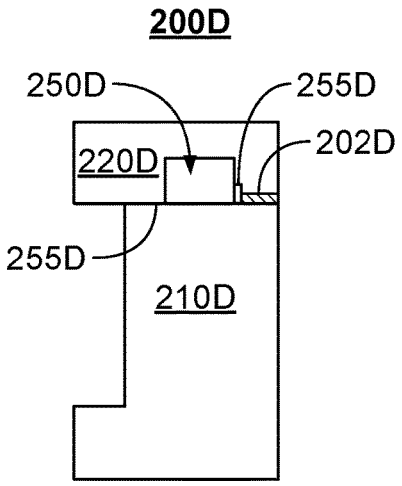

FIG. 2A-2D are diagrams depicting portions of embodiments of vacuum cell 200, 200B, 200C, and 200D having reduced inner chamber permeability. FIG. 2A depicts a top view of vacuum cell 200, while FIGS. 2B, 2C, and 2D depict a cross-sectional view of a portion of vacuum cells 200B, 200C, and 200D. Vacuum cells 200B, 200C, and 200D are analogous to vacuum cell 200. For clarity, FIGS. 2A-2D are not to scale.

Referring to FIG. 2A, vacuum cell 200 includes a vacuum cell structure that is formed by cover 220 being hermetically sealed to body 210. Between cover 220 and body 210 are inner chamber 230, buffer ion pump 240, and buffer channel 250. Cover 220, body 210, inner chamber 230, buffer ion pump 240, and buffer channel 250 are analogous to cover 120, body 110, inner chamber 130, buffer ion pump 140, and buffer channel 150, respectively. Consequently, vacuum cell 200 functions in an analogous manner to vacuum cell 100.

In addition, buffer ion pump 240 is depicted as including cathode 242 having grazing incident slits 243. Although only one cathode 242 is shown, in some embodiments, buffer ion pump 240 includes two cathodes (i.e. a double cathode) separated by an axial structure or captured on opposite sides individually. Grazing incident slits 243 are used to increase the grazing incidence impacts of ions in buffer bump 240. In some embodiments, the cathode(s) 242 and/or other components of buffer ion pump 240 may be configured differently.

Vacuum cell 200 also includes UHV ion pump 260 that resides in a cavity formed in body 210. UHV ion pump 260 is coupled to inner chamber 230 via conductance channel 280. UHV ion pump 260 may be activated to maintain or improve the vacuum in inner chamber 230. In the embodiment shown, UHV ion pump 260 includes cathode 264 having slits 263, aperture 264, and ion pump kickstarter 266. UHV ion pump 260 may be a split cathode ion pump having a single cathode 262. Cathode 262 also includes grazing incidence slits 263. Ion pump kickstarter 266 may be a source of particles and/or electrons used to aid in operation of UHV ion pump 260. Aperture 264 allows particles and/or electrons from ion pump kickstarter 266 to enter the desired region of UHV ion pump 260. In other embodiments, aperture 264 and ion pump kickstarter 266 may be omitted or located differently. Buffer channel 250 includes portion 252 that encircle UHV ion pump 260, reducing the permeation of helium into the region of UHV ion pump 260.

In operation, helium gas from the ambient permeates into buffer channel 250, for example through a depletion region (not shown in FIG. 2A). The helium gas also diffuses into buffer channel portion 252. The pressure within buffer channel 250 may increase. Buffer ion pump 240 is activated (e.g. periodically during a maintenance cycle) to remove helium (and/or other gases) that have permeated into buffer channel 250. Buffer ion pump 240 can, but need not, be activated during use of inner chamber 230. Buffer ion pump 240 may never be activated after its initial firing. Further, buffer ion pump 240 may be a HV ion pump having advantages, such as reduced size and improved stability, over a UHV ion pump. As a result, inner chamber 230 may be maintained at UHV pressures for longer times.

Eventually, however, permeation through depletion regions, cover 230 and/or other surfaces increases the helium background pressure of inner chamber 230 to intolerable levels. Without more pumping or other permeation mitigation features, inner chamber 230 may still become unusable. However, the presence of UHV ion pump 260 allows the usable life of inner chamber to be further extended. UHV ion pump 260 is fluidically coupled with inner chamber 230 and may be activated intermittently or continuously to remove helium (and other gases) from inner chamber 230. For example, UHV ion pump 260 may be activated only during use or just prior to use of inner chamber 230. However, UHV ion pump 260 generally has significantly lower efficiency than buffer ion pump 240. In some embodiments, UHV ion pump 260 can be assisted with kickstarter 266 that provides particles and/or ions through apertures 264 in cathode 262 directly into UHV ion pump 260. Escaping getterable gasses may be captured by a getter (not shown) between UHV ion pump 260 and inner chamber 230. Thus, various techniques for assisting the operation of UHV ion pump 260 may be employed. Some getters (not shown) may be made to temporarily reverse operation releasing captured gasses to assist the ion pump operation and pumping of helium, after which the getter is allowed to re-getter effused gasses.

Vacuum cell 200 also includes reservoir 254 that is fluidically coupled to buffer channel 250 (and thus to portion 252 of buffer channel 250 at the perimeter of UHV ion pump 260). In some embodiments, reservoir 254 is used to carry a bond sealant during fabrication of vacuum cell 200. More specifically, reservoir may be filled with a reflow metal or other sealant after partial or full assembly or vacuum processing. The sealant has a very low helium permeability. For example, in some embodiments, reservoir 254 may include a solid sealant (e.g. indium; other alloyed solid or gaseous sealants such as rubidium in gold, tantalum, or other alloys; and/or reversible compounds) that can be made to reflow. In some embodiments, the solid sealant is also present in channel 250 and/or portion 252. In some embodiments, the solid sealant is only present in channel 250 and/or portion 252. In such embodiments, reservoir 254 might be omitted while still allowing for the bond between cover 220 and body 210 to be sealed. The sealant may be placed, sputtered, evaporated, or otherwise applied to buffer channel 250 and/or reservoir 254. After bonding, the solid sealant (e.g. indium) in reservoir 254 and/or channel 250 may be liquefied. Vacuum cell may be manipulated such that the liquid indium (or other sealant) covers at least the depletion region and/or relevant areas of the bond. In some embodiments, a sealant that remains liquid during fabrication of vacuum cell 200 may be used (e.g. retained in reservoir 254 and/or in channel 250). However, use of a sealant that is liquid during other portions of the fabrication process may significantly complicate fabrication of vacuum cell 200. In some embodiments, the sealant may be in wire, granular, foil or other pliable or fillable forms and placed directly in the trenches of the buffer channel regions. In some embodiments, the filler material may be evaporated, sputtered, electroplated, or otherwise deposited into some portion of the trench comprising part or all of the buffer vacuum regions. In some embodiments, the sealant retained in reservoir 254 may allow for gaseous sealing of the bond between body 210 and cover 220. For example, reservoir 254 may include a material that when heated (or otherwise activated) provides a gaseous sealant that diffuses through buffer channel 250 and 252 into the depletion region and/or other relevant areas. For example, an alkali metal such as Rb and/or Cs may be placed in reservoir 254. The alkali metals may diffuse into cover 220 to reduce the depletion region. Thus, the permeability of the depletion region may be diminished. Other mechanisms for sealing the bond including but not limited to localized/precisely targeted annealing, thermal diffusion, and/or reverse bonding (which is performed such that portions of vacuum cell 200 that have been fabricated and the bond between cover 220 and body 210 are not adversely affected), providing an external conformal barrier layer (such as evaporative, sputter, electro or electroless plating), and/or other mechanism for bonding. For example, laser bonding or other bonding that limits or prevents the depletion region formation may be utilized to bond the conformal surfaces of cover 220 and body 210. Further, mechanisms for reducing the helium permeation rate of cover 220 may also be used. Such techniques may include providing an optically transparent barrier coating (e.g. silicon having a thickness of less than one hundred micrometers, an oxide having lower helium permeability, sapphire or $Al_2O_3$, and/or graphene) on transparent areas and/or pre-soaking glass cover 220 in alkali metals to engineer the permeation rate. Other materials used for cover 220 and/or body 210 may be made less effectively permeable with lower permeation or barrier conformal coatings such as graphene, sapphire/alumina ($Al_2O_3$), and/or nitrides. Such coatings may be applied as laminates, evaporated, sputtered, suspension dipped, transfers, vapor deposited and other appropriate means. Bonds may occur on top of, through or about masked portions of such coatings. Coatings may be inner surface, outer surface, or applied conformally to all surfaces. Bonding regions may be defined by mechanically masked regions, sacrificial masked regions, or post coating applications of bond sites precursors such as one or multiple metals or elements of a transient liquid phase (TLP), solder, diffusion, thermal diffusion or other type of bond preparation. Regions may be activated via chemical, plasma, mechanical, or laser activation, removal or preparation.

FIGS. 2B-2D depict cross-sectional views of embodiments of vacuum cells 200B, 200C and 200D that have been sealed utilizing a bond sealant that may be retained in reservoir 254. Vacuum cells 200B, 200C, and 200D are analogous to vacuum cell 200. Referring to FIG. 2B, vacuum cell 200B includes body 210B, cover 220B, and buffer channel 250B analogous to body 210, cover 220, and buffer channel 250. Depletion region 202B for an anodic bond between cover 220B and body 210B is also shown. Sealant 255B has been manipulated (e.g. by tipping vacuum cell 200B) such that it resides not only at the base of buffer channel 250B, but also at least partially up one or more sides. For example, after establishing a vacuum in which plasmas may be initiated, a plasma cleaning or ashing operation may be performed. This plasma may be ignited in buffer channel 250. Oxygen released via anodic bonding and or other gasses released by otherwise intentional or incidental degassing/decomposition processes in buffer channel 250 may be used to help form an oxygen or other gaseous plasma to affect the desired surface modification prior to sealant application/activation. During or after the plasma treatment, indium or other flowable sealant in reservoir 254 may be heated or vaporized and encouraged to flow through buffer channel 250B, covering the seam between cover 220B and body 210B and depletion region 202B. Thermal, electrostatic, surface modification, and/or other techniques may also be used to assist the flow of the sealant over depletion region 202B. Sealant 255B thus reduces the permeation of helium into buffer channel 250B and, therefore, inner chamber 230 (not shown in FIG. 2B).

Similarly, vacuum cell 200C includes body 210C, cover 220C, and buffer channel 250C analogous to body 210, cover 220, and buffer channel 250. Depletion region 202C for an anodic bond between cover 220C and body 210C is also shown. Sealant 255C has been manipulated (e.g. by vacuum cell 200C being tipped and turned upside down or vaporized) such that sealant 255C resides not only at the base of buffer channel 250C, but also at least partially up one or more sides and on the top surface of buffer channel 250C. Thus, depletion region 202C is covered. Sealant 255C thus reduces the permeation of helium into channel 250C and, therefore, inner chamber 230 (not shown in FIG. 2C). Vacuum cell 200D includes body 210D, cover 220D, and buffer channel 250D analogous to body 210, cover 220, and buffer channel 250. Depletion region 202D for an anodic bond between cover 220D and body 210D is also shown. Sealant 255D has diffused from a gas emitted by the sealant (not shown) in reservoir 254 into cover 220D. As a result, sealant 255*d* has reduced the size of depletion region 202D. Sealant 255D thus reduces the permeation of helium into channel 250D and, therefore, inner chamber 230 (not shown in FIG. 2D).

Vacuum cells 200, 200B, 200C, and 200D may share the benefits of vacuum cell 100. Thus, the usable life of inner chamber 230 (e.g. the amount of time that inner chamber 230 may be kept at UHV pressures) may be further extended through the combination of buffer channel 250, 250B, 250C, and/or 250D in combination with buffer ion pump 240. In addition, sealant 255B, 255C, and/or 255D further reduce the permeation of helium (and other gases) from the ambient into channels 250B, 250C, and 250D. As a result, buffer ion pump 240 may be run less frequently. Further, in some embodiments, sealant 255B, 255C, and/or 255D may be utilized without a buffer ion pump. In such embodiments, sealant 255B, 255C, and/or 255D extend the life of vacuum cells 200B, 200C, and/or 200D than buffer channels 250B, 250C, and/or 250D alone. The addition of UHV ion pump 260 also allows for removal of gases, such as helium, directly from inner chamber 230. Thus, vacuum cells 200, 200B, 200C, and/or 200D may have reduced permeability of gases such as helium into inner chamber 230 and, therefore, a significantly extended lifetime.

The components of vacuum cells described herein may be configured in a variety of ways not explicitly depicted or described. Consequently, features and their locations may be selected and/or mixed to provide a vacuum cell having the desired configuration. For example, a buffer channel may be provided in a body, in a cover, between parallel covers, using a subset thereof, or using all of the above. Similarly, buffer ion pumps, UHV pumps, and/or sealant may be omitted. Further, another number one or more components may be present. For example, although a single inner chamber and buffer channel are shown, multiple inner chambers and/or buffer channels may be present. FIGS. 3-7 depict various configurations of vacuum cells 300, 400, 500, 600, and 700. However, other configurations are possible.

Figure 3:
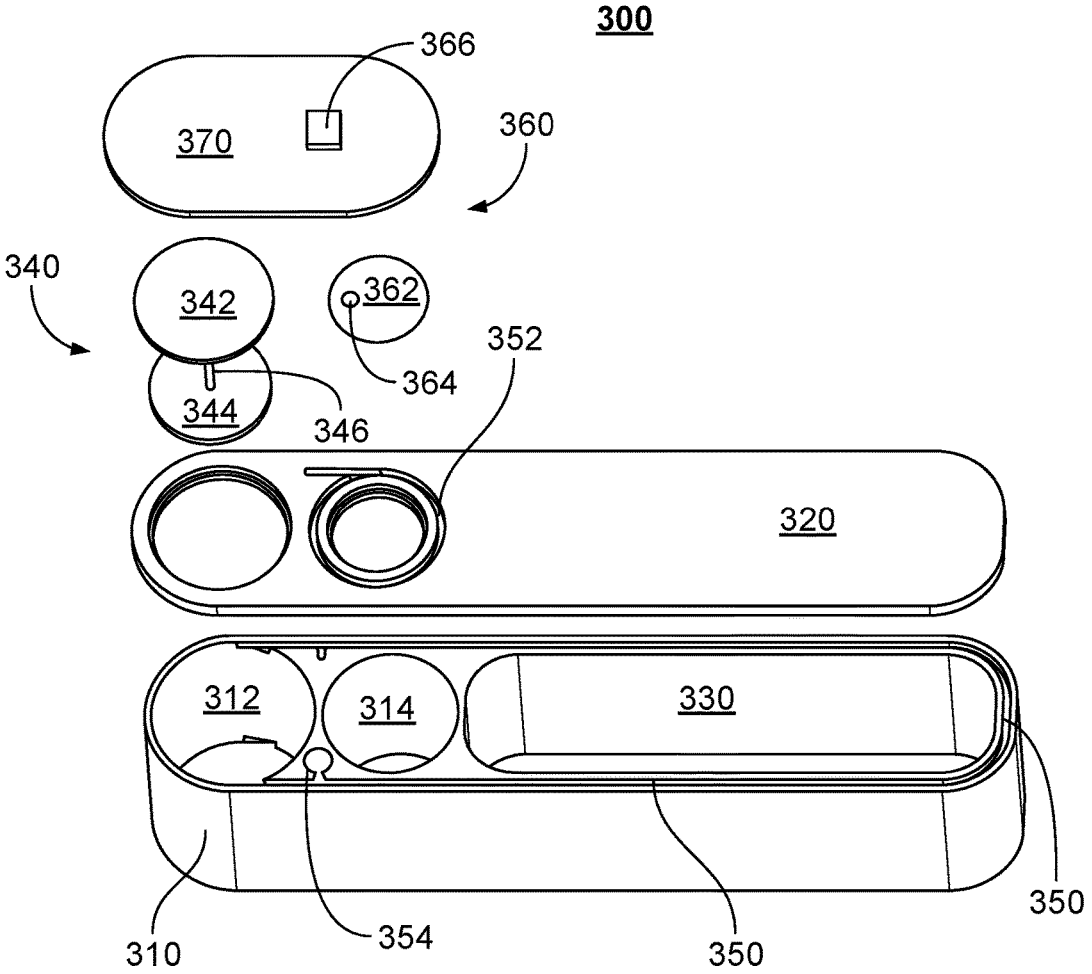
FIG. 3 depicts an exploded view of an embodiment of a vacuum cell having reduced inner chamber permeability.

FIG. 3 depicts an exploded view of an embodiment of vacuum cell 300 having reduced inner chamber permeability, for example to helium. Vacuum cell 300 is analogous to vacuum cells 100, 200, 200B, 200C, and/or 200D. For clarity, FIG. 3 is not to scale. Vacuum cell 300 includes cover 320 that is hermetically sealed to body 310. Between cover 320 and body 310 are inner chamber 330 (formed by a cavity in body 310), buffer ion pump 340, buffer channel 350, and UHV ion pump 360. Body 310, cover 320, inner chamber 330, buffer ion pump 340, buffer channel 350 having portion 352, reservoir 354, and UHV ion pump 360 are analogous to body 210, cover 220, inner chamber 230, buffer ion pump 240, buffer channel 250 having portion 252, reservoir 254, and UHV ion pump 260 respectively. Consequently, vacuum cell 300 functions in an analogous manner to vacuum cell(s) 100 and/or 200.

Buffer ion pump 340 and UHV ion pump 360 reside in chambers 312 and 314, respectively, of body 310. Although a channel connecting UHV ion pump 360 to inner chamber 330 is not explicitly shown, UHV ion pump 360 is fluidically coupled to inner chamber 330. Buffer channel 350 includes a portion formed in body 310 and portion 352 formed in cover 320. Portion 352 encircles UHV ion pump 360 and is fluidically connected to the remaining portion of buffer channel 350. Buffer ion pump 340 includes cathodes 342 and 344 and rod 346. Cathodes 342 and 344 are analogous to cathode 242. UHV ion pump 340 includes cathode 362, aperture 364 and ion pump kickstarter 366 that are analogous to cathode 262, aperture 264, and ion pump kickstarter 266. Although grazing incidence slits are not shown in cathodes 342, 344, and 362 such slits may be present in cathode(s) 324, 344, and/or 362. Also shown is plate 370 used to seal HV buffer ion pump 340 and UHV ion pump 360.

Vacuum cell 300 may share the benefits of vacuum cell(s) 100 and/or 200. Thus, the usable life of inner chamber 330 may be further extended through the combination of buffer channel 350, buffer ion pump 340, UHV ion pump 360, and bond sealant (not explicitly shown). Thus, vacuum cell 300 may have reduced permeability of gases such as helium into inner chamber 330 and a significantly extended lifetime.

Figure 4:
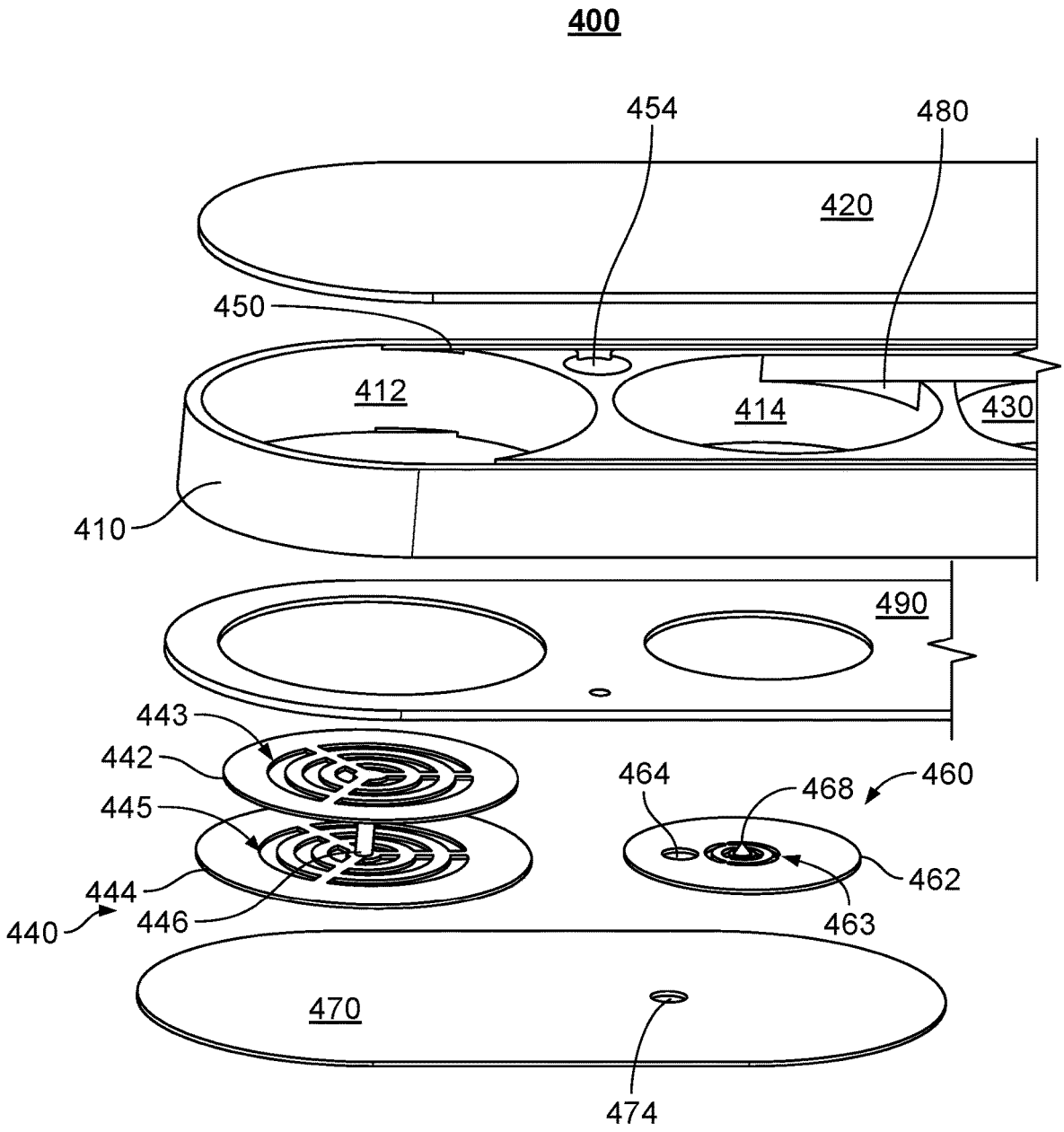
FIG. 4 depicts an exploded view of a portion of an embodiment of a vacuum cell having reduced inner chamber permeability.

FIG. 4 depicts an exploded view of a portion of an embodiment of vacuum cell 400 having reduced inner chamber permeability, for example to helium. Vacuum cell 400 is analogous to vacuum cells 100, 200, 200B, 200C, 200D, and/or 300. For clarity, FIG. 4 is not to scale. Vacuum cell 400 includes cover 420 that is hermetically sealed to body 410. Between cover 420 and body 410 are inner chamber 430 (formed by a through hole in body 410 and a portion of plate 490), buffer ion pump 440 in chamber 412 (formed by through holes in body 410 and plate 490 and a portion of plate 470), buffer channel 450, reservoir 454, UHV ion pump 460 in chamber 414 (formed by through holes in body 410 and plate 490 and a portion of plate 470), and conductance channel 480. Body 410, cover 420, inner chamber 430, buffer ion pump 440 in chamber 412, buffer channel 450, reservoir 454, UHV ion pump 460 in chamber 414, and conductance channel 480 are analogous to body 310, cover 320, inner chamber 330, buffer ion pump 340 in chamber 312, buffer channel 350, reservoir 354, UHV ion pump 360 in chamber 314, and conductance channel 280, respectively. Consequently, vacuum cell 400 functions in an analogous manner to vacuum cell(s) 100, 200 and/or 300.

Buffer channel 450 includes a portion formed in body 410. Although not shown in FIG. 4, buffer channel may include a portion that surrounds UHV ion pump 460 and that is formed in cover 420 and/or body 410. Buffer ion pump 440 includes cathodes 442 and 444 and rod 446, which are analogous to cathodes 342 and 344 and rod 346. UHV ion pump 460 includes cathode 462 and aperture 464 that are analogous to cathode 362 and aperture 364. In addition, cathodes 442, 444, and 462 include grazing incidence slits 443, 445, and 463, respectively. In other embodiments, such slits may be omitted. Plate 490 forms the bottom of inner chamber 430. Thus, the body of vacuum cell 400 may be considered to include both body 410 and plate 490. Plate 470 is used to seal HV buffer ion pump 440 and UHV ion pump 460 is analogous to plate 370. Plate 470 also includes an aperture 474 through which particles and/or electrons may be injected as a kickstarter for UHV ion pump 460. UHV ion pump 460 also includes structure 468 configured to improve the grazing incidence and give a field focus point for UHV ion pump 460. Thus, structure 468 may aid in startup of UHV ion pump 460.

Vacuum cell 400 may share the benefits of vacuum cell(s) 100, 200 and/or 300. Thus, the usable life of inner chamber 430 may be further extended through the combination of buffer channel 450, buffer ion pump 440, UHV ion pump 460, and bond sealant (not explicitly shown). Thus, vacuum cell 400 may have reduced permeability of gases such as helium into inner chamber 430 and a significantly extended lifetime.

Figure 5:
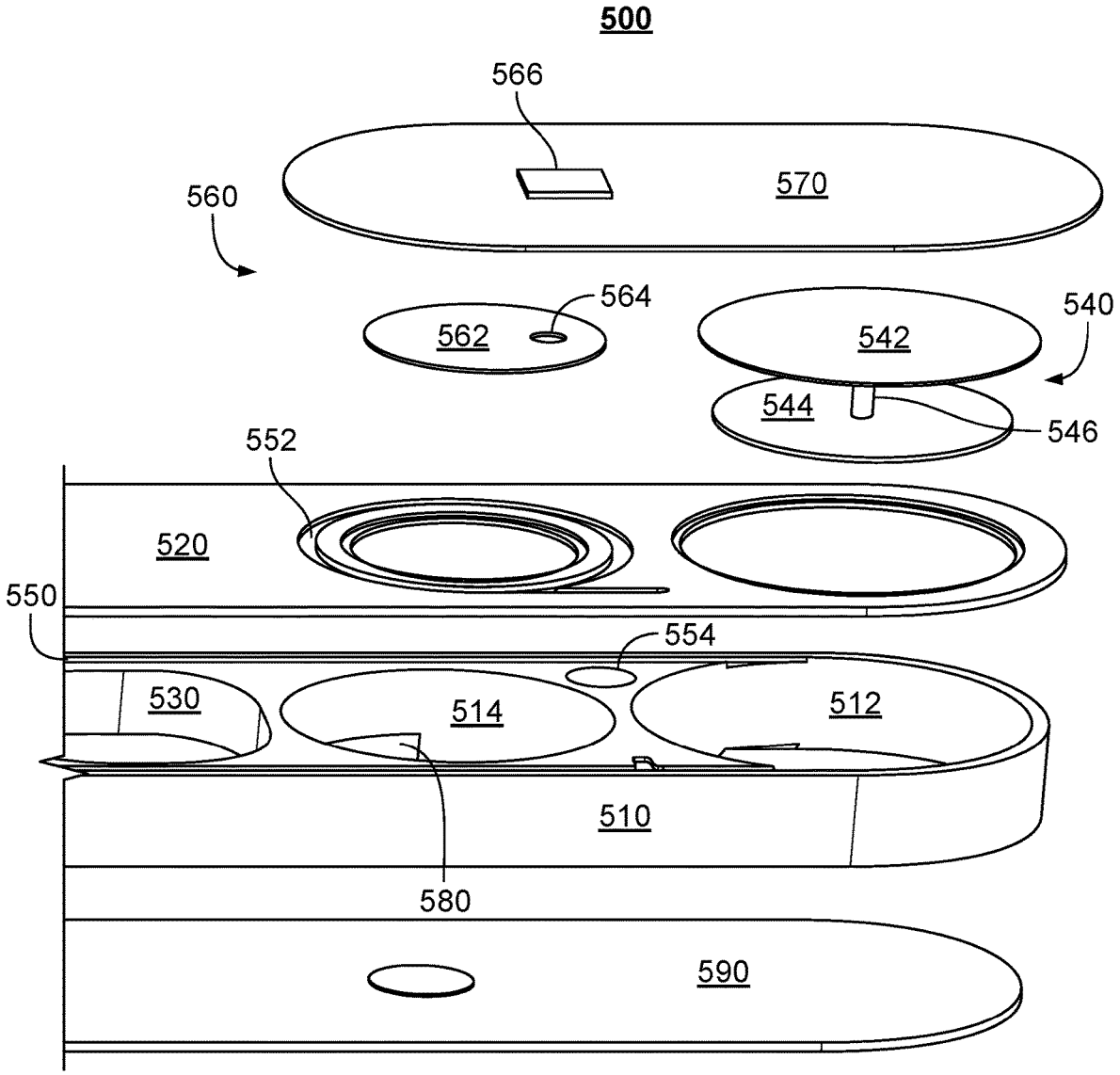
FIG. 5 depicts an exploded view of a portion of an embodiment of a vacuum cell having reduced inner chamber permeability.

FIG. 5 depicts an exploded view of a portion of an embodiment of vacuum cell 500 having reduced inner chamber permeability, for example to helium. Vacuum cell 500 is analogous to vacuum cells 100, 200, 200B, 200C, 200D, 300, and/or 400. For clarity, FIG. 5 is not to scale. Vacuum cell 500 includes cover 520 that is hermetically sealed to body 510. Between cover 520 and body 510 are inner chamber 530 (formed by a through hole in body 510 and plate 590), buffer ion pump 540 in chamber 512 (formed by an aperture in body 510 and plate 590), buffer channel 550, reservoir 554, UHV ion pump 560 in chamber 514 (formed by an aperture in body 510 and plate 590), and conductance channel 580 formed in the opposite side of body 510 from channel 550. Body 510, cover 520, inner chamber 530, buffer ion pump 540 in chamber 512, buffer channel 550, reservoir 554, UHV ion pump 560 in chamber 514, conductance channel 580, plate 570, and plate 590 are analogous to body 410, cover 420, inner chamber 430, buffer ion pump 440 in chamber 412, buffer channel 450, reservoir 454, UHV ion pump 460 in chamber 414, conductance channel 480, plate 470, and plate 490, respectively. Consequently, vacuum cell 500 functions in an analogous manner to vacuum cell(s) 100, 200, 300 and/or 400.

Buffer channel 550 includes a portion formed in body 510 and portion 552 formed in cover 520. Portion 552 is coupled with the remaining portion of buffer channel 550 through an aperture in plate 520. Buffer ion pump 540 includes cathodes 542 and 544 and rod 546, which are analogous to cathodes 442 and 444 and rod 446. UHV ion pump 560 includes cathode 562 and aperture 564 that are analogous to cathode 462 and aperture 464. Although not shown, cathodes 542, 544, and 562 may include grazing incidence slits. Plate 570 seals HV buffer ion pump 540 and UHV ion pump 560 in vacuum cell 500. Plate 570 is analogous to plate 470, but is bonded to cover 520 instead of a plate. Plate 570 also includes an aperture (not shown) through which particles and/or electrons may be injected from kickstarter 566, which is analogous to kickstarter 366.

Vacuum cell 500 may share the benefits of vacuum cell(s) 100, 200, 300 and/or 400. Thus, the usable life of inner chamber 530 may be further extended through the combination of buffer channel 550, buffer ion pump 540, UHV ion pump 560, and bond sealant (not explicitly shown). Thus, vacuum cell 500 may have reduced permeability of gases such as helium into inner chamber 530 and a significantly extended lifetime.

Figure 6:
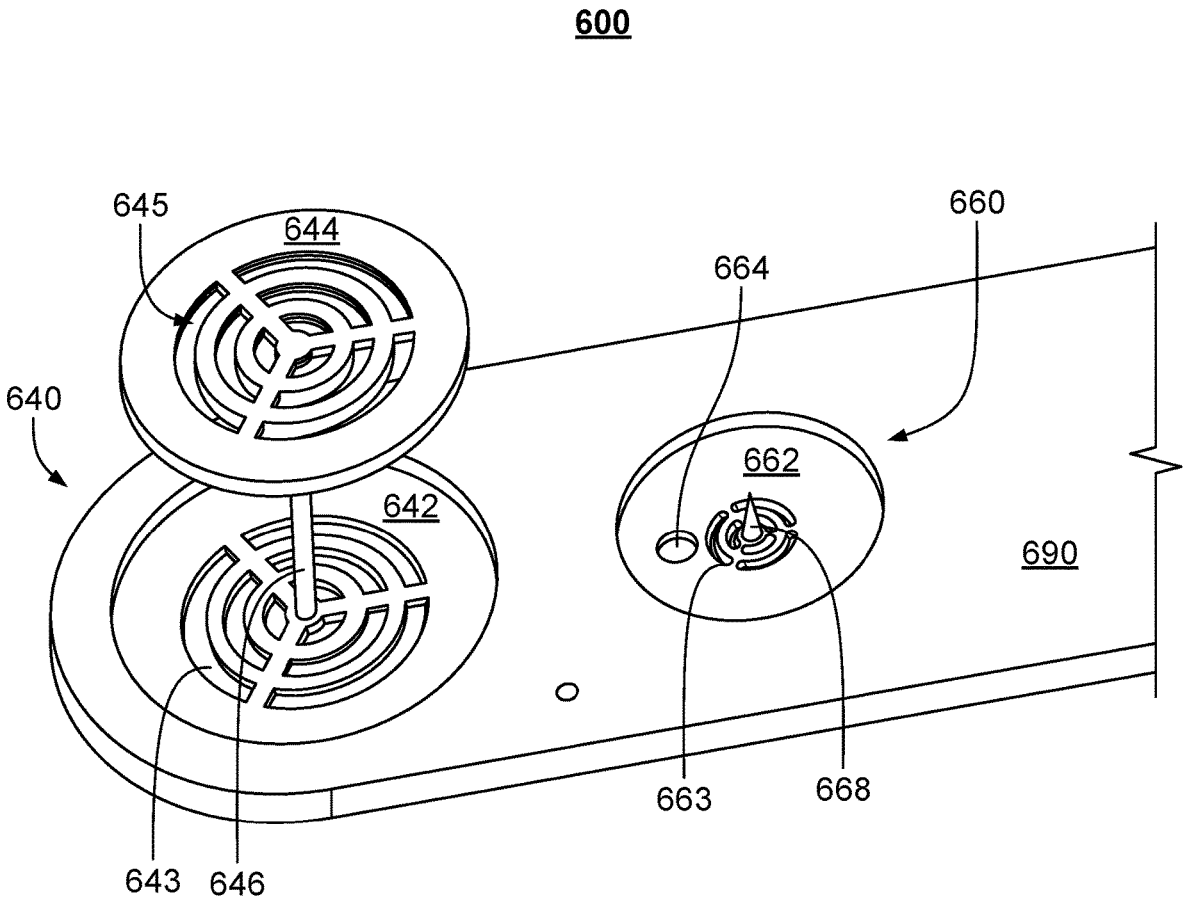
FIG. 6 depicts a portion of an embodiment of a vacuum cell having reduced inner chamber permeability.

FIG. 6 depicts a portion of an embodiment of vacuum cell 600 having reduced inner chamber permeability, for example to helium. Vacuum cell 600 is analogous to vacuum cells 100, 200, 200B, 200C, 200D, 300, 400, and/or 500. For clarity, FIG. 6 is not to scale. In addition, only the assembly including buffer ion pump 640, UHV ion pump 660, and plate 690 is shown. Remaining portions of vacuum cell 600, such as the buffer channel, inner chamber, cover, and body are not shown.

Buffer ion pump 640 may be a HV ion pump including cathodes 642 and 644 and rod 646, which are analogous to cathodes 442 and 444 and rod 446. UHV ion pump 660 includes cathode 662 and aperture 664 that are analogous to cathode 462 and aperture 464. Cathodes 642, 644, and 662 may include grazing incidence slits 643, 645, and 663. Cathode 662 also includes aperture 664 through which particles and/or electrons may be injected from a kickstarter (not shown). UHV ion pump 660 also includes axial structure 668 that is analogous to structure 468.

Vacuum cell 600 may share the benefits of vacuum cell(s) 100, 200, 300, 400 and/or 500. Thus, the usable life of inner chamber (not shown) may be further extended through the combination of a buffer channel (not shown), buffer ion pump 640, UHV ion pump 660, and bond sealant (not explicitly shown). Thus, vacuum cell 600 may have reduced permeability of gases such as helium into inner chamber 630 and a significantly extended lifetime.

FIGS. 7A-7E depict cross-sectional views of portions embodiments of portions of vacuum cells 700A, 700B, 700C, 700D and 700E having reduced inner chamber permeability, for example to helium. For clarity, FIGS. 7A-7E are not to scale. Vacuum cells 700A, 700B, 700C, 700D and 700E are analogous to vacuum cell(s) 100, 200, 200B, 200C, 200D, 300, 400, 500 and/or 600. Vacuum cells 700A, 700B, 700C, 700D and 700E depict mechanisms for mitigating helium permeation that may be used in addition to or in lieu of other techniques described herein.

Vacuum cell 700A includes cover 720A that is hermetically sealed to body 710A. For example, cover 720A may be a borosilicate or other glass, while body 710A may be silicon. Also shown is buffer channel 750A in cover 720A. In other embodiments, some or all of buffer channel 750A may be formed in body 710A. Depletion region 702A has been formed by the bonding process. External barrier coating 707A has been provided on body 710A and cover 720A. Although external barrier coating 707A is shown as extending over a particular portion of vacuum cell 700A, in some embodiments, barrier coating 707A may extend over other and/or additional portions of vacuum cell 700A. However, coating 707A is generally desired to cover depletion region 702A and/or the seam at which cover 720A is bonded to body 710A. If barrier coating 707A is transparent (e.g. $Al_2O_3$), barrier coating 707A may extend over cover 720A, while providing optical access to the inner chamber. Barrier coating 707A may thus reduce or prevent helium permeation into vacuum cell 700A.

Vacuum cell 700B includes cover 720B that is hermetically sealed to body 710B. For example, cover 720B may be a borosilicate or other glass, while body 710B may be silicon. Also shown is buffer channel 750B in cover 720B. In other embodiments, some or all of buffer channel 750B may be formed in body 710B. Depletion region 702B has been formed by the bonding process. However, bonding has been performed such that depletion region 702B has a gradient and maximum depth that may be less than the thickness of cover 720B in the region. This is indicated by the triangular shape of depletion region 702B. However, depletion region 702B may have another shape, including but not limited to having a maximum within cover 720B instead of at an edge of cover 720B. In order to form depletion region 702B, a larger electric field may be present at the outer edge of cover 720B during bonding. This results in a larger depletion region near the outer edge and a smaller depletion region within cover 720B. The bond between cover 720B and body 710B may also have a gradient in strength (i.e. be weaker in some regions). However, the bond formed is sufficient to for use of vacuum cell 700B. Thus, the configuration of depletion region 702B may reduce or prevent helium permeation into vacuum cell 700B.

Vacuum cell 700C includes cover 720C that is hermetically sealed to body 710C. For example, cover 720C may be a borosilicate or other glass, while body 710C may be silicon. Although no buffer channel is shown in vacuum cell 700C, a buffer channel may be present. Depletion region

702C has been formed by a combination of the bonding process and feature 707C. Depletion region 702C is analogous to depletion region 702B. Further, an analogous depletion region (not shown) may be present near the opposing edge of body 710C. The presence of feature 707C tends to concentrate the electric field from electrode 705C near the outer edge of cover 720C. Although shown as a rectangular trench, feature 707C may have another configuration that concentrates the electric field during bonding in the desired manner. This results in a larger depletion region (and stronger bond) near the outer edge and a smaller depletion region within cover 720C. The bond formed between cover 720C and body 710C is sufficiently strong for the use of vacuum cell 700C. Thus, the configuration of depletion region 702C may reduce or prevent helium permeation into vacuum cell 700C.

Vacuum cell 700D includes cover 720D that is hermetically sealed to body 710D. For example, cover 720D may be a borosilicate or other glass, while body 710D may be silicon. Although no buffer channel is shown in vacuum cell 700C, a buffer channel may be present. Depletion region 702D has been formed by a combination of the bonding process and the configuration of cover 720D. In particular, cover 720D includes feature 707D and bevel 709D. Feature 707D is analogous to feature 707C. In some embodiments, feature 707D may be omitted and/or configured in a different manner. Depletion region 702D is analogous to depletion region 702B. Further, an analogous depletion region (not shown) may be present near the opposing edge of body 710D. The presence of feature 707D and bevel 709D tends to concentrate the electric field from electrode 705D near the outer edge of cover 720D. This results in a larger depletion region (and stronger bond) near the outer edge and a smaller depletion region within cover 720D. The bond formed between cover 720D and body 710D is sufficiently strong for the use of vacuum cell 700D. Thus, the configuration of depletion region 702D may reduce or prevent helium permeation into vacuum cell 700D.

Vacuum cell 700E includes cover 720E that is hermetically sealed to body 710E. For example, cover 720E may be a borosilicate or other glass, while body 710E may be silicon. Buffer channel 750E is shown as being in cover 720E. In some embodiments, some or all of buffer channel 750E may be in body 710E. After bonding, vacuum cell 700E has been treated to reduce the extent of depletion region 702E. Vacuum cell 700E may undergo short term thermal diffusion (e.g. annealing) or a reverse bond to drive depleted ions into the depletion region. In some embodiments, laser annealing may be performed. For reverse bonding, cover 720E may be anodically bonded to body 710E by preparing, cleaning and bringing into contact the conformal glass-silicon surfaces, applying heat for sufficient ion mobility to bond, and applying a high voltage to drive the anodic bond. This voltage may be applied until, for example, the entire perimeter of cover 720E is sealed to body 710E (e.g. final bonding current is less than ten percent of the peak bonding current). For a reverse bond, the polarity of the voltage may be reversed for a particular time or, e.g., until a fraction (e.g. ten percent through ninety percent) of the total integrated current of the initial forward bonding time or current is reached. Although the polarity of the voltage is reversed, the magnitude selected may be reduced such that a lower reverse bonding current is present. In some embodiments, the reverse bonding may be monitored (e.g. optically to detect a change in reflectivity, polarization, or other optical characteristic) to determine when to terminate reverse bonding. The reverse bonding is limited to ensure that debonding, salt deposition and/or other damage to the bond that compromises the hermetic seal does not occur. Vacuum cell 700E may then be cooled. A reduction in depletion region 702E may be achieved. Thus, the configuration of depletion region 702E may reduce or prevent helium permeation into vacuum cell 700E. In such embodiments, heat to increase ion mobility or diffusion may be applied globally, locally through resistive heating, targeted such as with laser radiation (e.g. continuous wave, pulsed or ultrafast to keep thermal affects very localized) and/or by other means. Surface emissivity of components may be engineered to further improve control, isolation, or efficiency of heating efforts.

Figure 8:
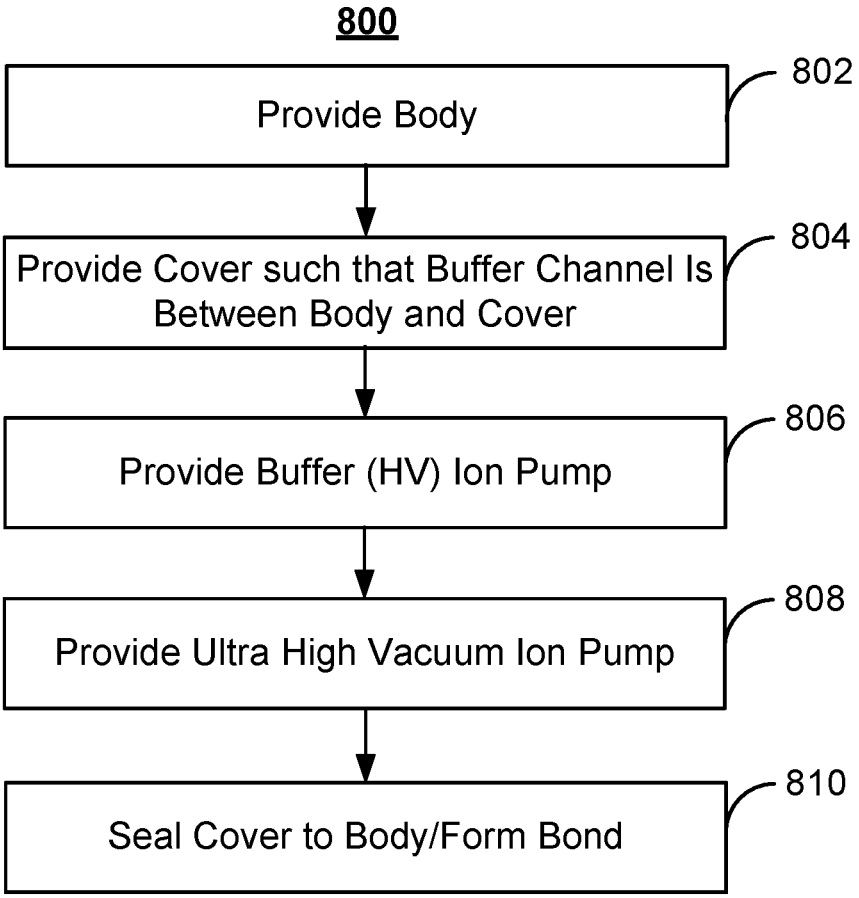
FIG. 8 is a flow chart depicting an embodiment of a method for providing a vacuum cell having reduced inner chamber permeability.

FIG. 8 is a flow chart depicting an embodiment of method 800 for providing a vacuum cell having reduced inner chamber permeability. Method 800 may include other and/or additional steps or substeps.

A body is provided, via 802. The body includes an inner chamber and a buffer chamber, or cavity. The buffer chamber is configured for the buffer ion pump, while the inner chamber is configured to be at UHV for the desired application of the vacuum cell. For example, a one centimeter thick, two inch wide and two inch long silicon body piece may be machined at 802. In some embodiments, cavities for the inner chamber and buffer chamber are formed in the silicon piece. In other embodiments, through holes may be provided. In such embodiments, formation of the cambers in the body may also include providing plate(s) for sealing one side of the through holes. In some embodiments, a chamber for a UHV ion pump for the inner chamber is also provided. For example, an additional through hole may be provided in the silicon piece. In such an embodiment, the chamber for the UHV ion pump may also include providing a plate to seal one side of the through hole. A reservoir for bond sealant may also be provided in the body at 802.

A cover is provided, at 804. The cover is provided such that a buffer channel is between the body and cover. In some embodiments, a depression for the buffer channel is formed in the cover. In some embodiments, a depression for the buffer channel is formed in the body. In some embodiments, depressions for portions of the buffer channel are formed in the cover and the body. 804 also includes ensuring that the buffer channel is fluidically connected with the buffer cavity and fluidically isolated from the inner chamber.

A buffer ion pump is provided in the buffer chamber, at 806. In some embodiments, a UHV ion pump is provided in the additional chamber, at 808. In other embodiments, 808 may be omitted.

The cover is hermetically sealed to the body by a bond, at 810. Thus, the inner chamber, buffer chamber, buffer channel, buffer ion pump, and UHV ion pump (if present) are fluidically disconnected from the ambient external to the vacuum cell. In some embodiments, the sealing at 810 also includes sealing or otherwise treating the bond to reduce helium permeation.

For example, referring to FIG. 3, body 310 having inner chamber 330, buffer chamber 312, and UHV ion pump chamber 314 is formed at 802. In addition, reservoir 354 may be formed at 802. Cover 320 is provided, at 804. In some embodiments, buffer channel 350 and portion 352 are provided at 804. However, buffer channel 350 may be considered to be formed as part of 802, while portion 352 is formed at 804. Buffer ion pump 340 and UHV ion pump 360 are provided at 806 and 808, respectively. Cover 320 is hermetically sealed to body 310, at 810. Thus, using method 800, vacuum cells having extended lifetimes may be provided.

Figure 9:
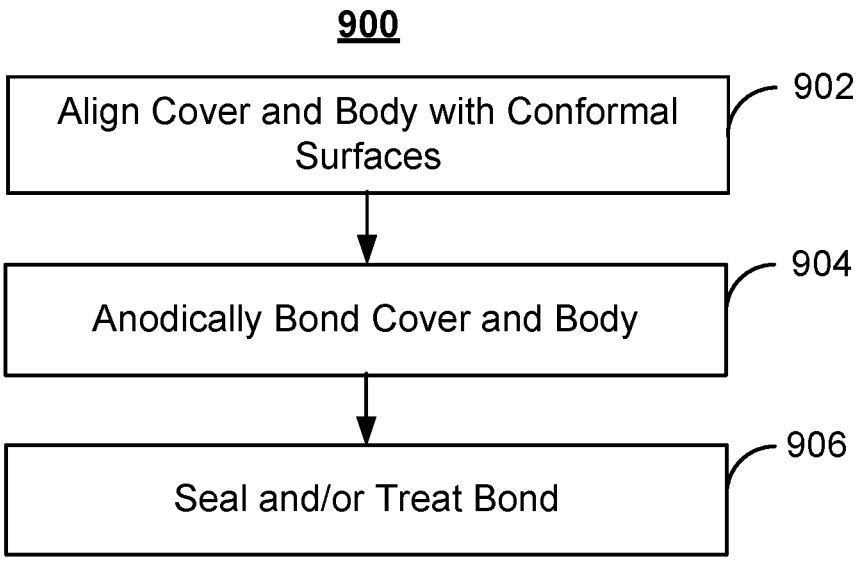
FIG. 9 is a flow chart depicting an embodiment of a method for sealing a vacuum cell.

FIG. 9 is a flow chart depicting an embodiment of method 900 for sealing a vacuum cell. Method 900 may include other and/or additional steps or substeps.

The surfaces of the cover and body desired to be bonded are aligned and brought into contact, at 902. These bonding surface are desired to be conformal. The cover and body are anodically bonded, at 904. For example, the cover and/or body may be heated and subjected to a voltage sufficient to form the desired anodic bond. In some embodiments, the anodic bonding performed at 904 is performed such that a reduced depletion region is formed. For example, the location of the electrodes, configuration of the cover or body, and/or other aspects of the bonding may be performed to provide a gradient in the depletion region. Thus, the depletion region may terminate within the cover.

At 906, the bonds are optionally sealed and/or treated to reduce helium permeation. For example, the bonds may be annealed, undergo reverse bonding, or sealed with a sealant such as a reflow metal or via diffusion. In some embodiments, 906 may be omitted.

Figure 7A:
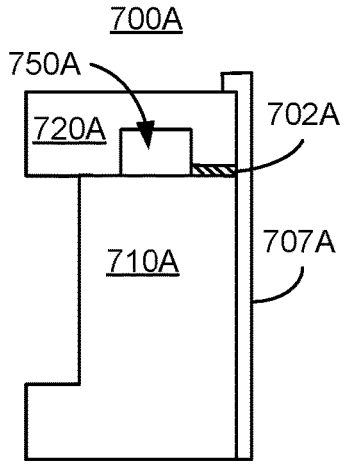
FIGS. 7A-7E depict embodiments of portions of vacuum cells having reduced inner chamber permeability.
Figure 7B:
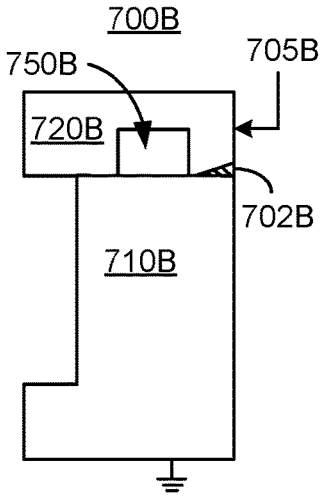
Figure 7C:
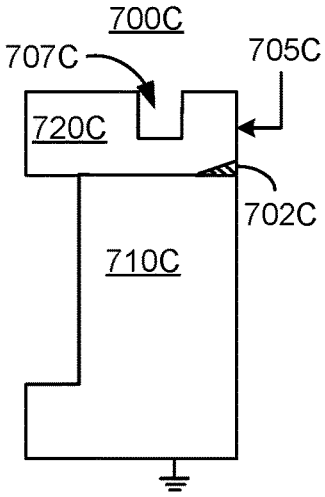
Figure 7D:
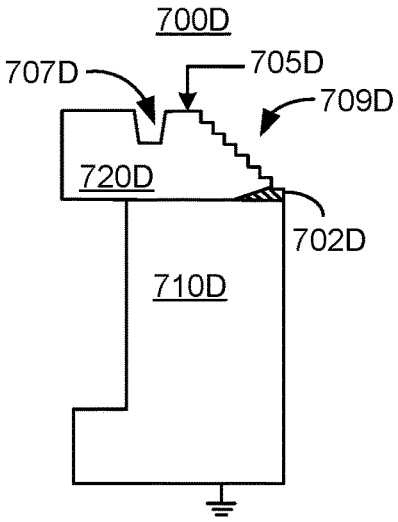
Figure 7E:
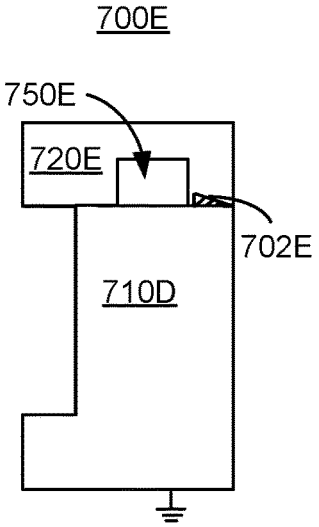

For example, the cover may be aligned and brought into contact with body, at 902. At 904, the cover and body are anodically bonded. In some embodiments, the cover may include features or be beveled (e.g. as shown in FIGS. 7C and 7D), and/or the electrode may be located in a desired region (as indicated in FIG. 7B) to provide a gradient in the depletion region. At 906, the vacuum cell may be heated and manipulated such that sealant 255B or 255C within buffer channel 250B or 250C covers depletion region 202B or 202C. In some embodiments, at 906 material in reservoir 254 is activated to diffuse into the walls of channel 250D, forming sealant 255D. In some embodiments, 906 may include depositing a barrier layer, such as barrier layer 707A of FIG. 7A, on the vacuum cell. In some embodiments, 906 may include annealing or performing a reverse bond to reduce the depletion region, as indicated by depletion region 702E of FIG. 7E. Thus, using method 900, bonds may be configured such that vacuum cells having extended lifetimes are provided.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. A vacuum cell, comprising:
an inner chamber;
a buffer channel, wherein the buffer channel is fluidically isolated from the inner chamber and from an ambient external to the vacuum cell;
a buffer ion pump fluidically coupled to the buffer channel and fluidically isolated from the ambient and the inner chamber;
a body; and
a cover hermetically sealed to the body by a bond, the inner chamber and the buffer channel being between an inner surface of the body and the cover, the buffer channel being between the bond and the inner chamber.

2. The vacuum cell of claim 1, wherein at least one of the body or the cover has a depletion region proximate to the bond, the depletion region having a first thickness proximate to the ambient and a second thickness proximate to the buffer channel, the first thickness being greater than the second thickness.

3. The vacuum cell of claim 1, further comprising:
a bond sealant residing in the buffer channel, the bond sealant adjoining at least a portion of the bond.

4. The vacuum cell of claim 3, wherein the bond sealant includes at least one of a flowed sealant or a diffused sealant.

5. The vacuum cell of claim 4, further comprising:
a bond sealant reservoir.

6. The vacuum cell of claim 1, wherein the cover includes at least one of a beveled edge, a stepped edge, or a feature for concentrating electric field at an edge of the cover.

7. A vacuum cell, comprising:
an inner chamber;
a buffer channel, wherein the buffer channel is fluidically isolated from the inner chamber and from an ambient external to the vacuum cell; and
a buffer ion pump fluidically coupled to the buffer channel and fluidically isolated from the ambient and the inner chamber;
wherein the vacuum cell includes a buffer ion pump chamber fluidically coupled with the buffer channel and a high vacuum pump chamber fluidically coupled with the inner chamber, the high vacuum pump chamber being fluidically isolated from the buffer channel, the buffer ion pump residing in the buffer ion pump chamber, the vacuum cell further comprising:
an ultra-high vacuum pump residing in the high vacuum pump chamber.

8. The vacuum cell of claim 7, wherein the ultra-high vacuum pump is an ultra-high vacuum ion pump.

9. The vacuum cell of claim 7, wherein the buffer channel includes a high vacuum pump chamber portion surrounding a portion of the high vacuum pump chamber.

10. A vacuum cell, comprising:
a body;
a cover hermetically sealed to the body by a bond, an inner chamber and a buffer channel being between the cover and the body, the buffer channel fluidically isolated from the inner chamber and from an ambient external to the vacuum cell, the buffer channel being between the bond and the inner chamber;
a buffer ion pump fluidically coupled to the buffer channel and fluidically isolated from the ambient and the inner chamber; and
an ultra-high vacuum pump fluidically coupled with the inner chamber and fluidically isolated from buffer channel.

11. A method for providing a vacuum cell, comprising:
providing a body having an inner chamber and a buffer chamber;
providing a buffer ion pump in the buffer chamber; and
hermetically sealing a cover to the body by a bond, a buffer channel being formed between an inner surface of the body and the cover, the buffer channel being fluidically coupled to the buffer ion pump and fluidically isolated from an ambient and the inner chamber.

12. The method of claim 11, wherein the bond is an anodic bond and wherein the hermetically sealing further includes:
forming the anodic bond between the body and the cover, at least one of the body or the cover having a depletion region proximate to the anodic bond.

13. The method of claim 12, further comprising:
forming the anodic bond such that the depletion region has a first thickness proximate to the ambient and a second thickness proximate to the buffer channel, the first thickness being greater than the second thickness.

14. The method of claim 12, further comprising:

providing a bond sealant residing in the buffer channel, the bond sealant adjoining at least a portion of the bond.

15. The method of claim 14, wherein the bond sealant is selected from a flowed sealant and a diffused sealant.

16. The method of claim 12, further comprising:

annealing the anodic bond.

17. The method of claim 11, further comprising:

providing an ultra-high vacuum pump fluidically coupled with the inner chamber and fluidically isolated from the buffer channel.

18. The method of claim 17, wherein the ultra-high vacuum pump is a high vacuum ion pump.

19. The method of claim 17, wherein the buffer channel includes a high vacuum pump chamber portion surrounding a portion of the ultra-high vacuum pump.

* * * * *